US005573131A

United States Patent [19]

Berjis

[11] Patent Number: 5,573,131

[45] Date of Patent: Nov. 12, 1996

[54] APPARATUS FOR FORMING A CONTAINER TO HOLD A DRINKING CUP AT THE BOTTOM END OF THE CONTAINER AND TO HOLD FOOD IN THE UPPER PORTION OF THE CONTAINER

[75] Inventor: Pejman A. Berjis, Albany, Calif.

[73] Assignee: Devine Holdings, LLC, Los Angeles, Calif.

[21] Appl. No.: 329,227

[22] Filed: Oct. 26, 1994

[51] Int. Cl.[6] ..... B65D 21/02

[52] U.S. Cl. ..... 220/4.03; 220/503; 220/505; 220/529; 220/710

[58] Field of Search ..... 220/521, 4.03, 220/4.01, 503, 505, 509, 529, 705, 709, 710, 527; 215/6; 206/501

[56] References Cited

U.S. PATENT DOCUMENTS

| | | | |
|---|---|---|---|
| 512,109 | 1/1894 | Hinman | 220/521 |
| 781,053 | 1/1905 | De Vore | 215/6 |
| 1,665,289 | 4/1928 | Weaver | 220/521 |
| 3,288,344 | 11/1966 | Woollen et al. | 206/541 |
| 4,714,173 | 12/1987 | Ruiz | 220/709 |
| 4,811,860 | 3/1989 | Sorenson et al. | 220/710 |
| 5,050,759 | 9/1991 | Marble | 220/705 |
| 5,180,079 | 1/1993 | Jeng | 220/521 |
| 5,388,729 | 2/1995 | Gerringer | 215/6 |
| 5,420,910 | 4/1995 | Pilney | 220/570 |
| 5,460,291 | 10/1995 | Kerstiens | 220/529 |

FOREIGN PATENT DOCUMENTS

| | | | |
|---|---|---|---|
| 2649080 | 1/1991 | France | 220/527 |

*Primary Examiner*—Stephen J. Castellano
*Attorney, Agent, or Firm*—Thomas I. Rozsa; Tony D. Chen

[57] ABSTRACT

An attachment to the top of a softdrink cup typically used in fast food restaurants and snack bars. Conal container attachment (1) and locking device (2) come together to attach to the top of the drinking cup. In effect the cup attachment creates a space to hold a snacking food like popcorn or french fries on top of the cup. Accordingly, one can use one instead of two hands to carry both items at once.

7 Claims, 5 Drawing Sheets

APPARATUS FOR FORMING A CONTAINER TO HOLD A DRINKING CUP AT THE BOTTOM END OF THE CONTAINER AND TO HOLD FOOD IN THE UPPER PORTION OF THE CONTAINER

FIELD OF INVENTION

This invention relates to cup attachments, specifically an attachment to paper and plastic cups used to hold drinks.

PRIOR ART

Snacking foods and refreshments are sold at many establishments like restaurants, movie theatres, concert halls, sports stadiums, convenient stores, amusement parks, and theme parks. Many people usually buy a refreshment like water, soft drink, or juice along with a snacking food like pretzels, popcorn, french fries, or potato chips. Eventhough these items are bought together, they are sold in two separate containers; this is not very convenient for a person who has to use both hands to carry both items. It would be more convenient to have one container which could carry both items. Many establishments have employed the use of cardboard trays which hold many of these items together; and yet, this is only good from the place of purchase to the destination. After that the tray is of no use.

At the movies, as an example, one usually purchases a paper bag or a paper cup of popcorn and a paper cup of refreshment. After this purchase, one needs to carry both items as well as one's coat and movie tickets towards the entrance where an attendant checks the tickets. The procession continues towards the movie theatre where one needs to push the door open while carrying all of these items in both hands. After reaching the theatre seats, one needs to pull down the seat in order to sit down. As it can be seen, it is very difficult to handle all of these items while trying to do other tasks. Because of this problem, people tend to spill the beverage and the popcorn onto the ground; they also walk slower, trying not to spill anything, which frustrates and slows down the traffic coming from behind.

When the movie starts, it is very dark, and it is very hard to see anything. It is not convenient to hold both a popcorn and a drink while watching a movie. For this reason many people place one of the items, in front of their seat, on the ground, which makes it easy to spill since nobody can see it in the dark. Some theatres have placed a cupholder on the seat armrest; but unfortunately, this only holds one item at a time. Because of this, many people place their cups on the ground. One problem which this imposes is that people repeatedly bend down and up, to get their popcorn and place it back again. To the people siting behind, this is very annoying since it interrupts their watching the movie. It would be easier to hold a combined container, of the two cups, which separately contains both the drink and the popcorn: both items are always in close proximity of the other so that one can consume both items at the same time; one can carry both items in one hand at all times; the other hand is vacant to perform other tasks; it is not necessary to move around placing the snacks in different areas; there is less of a chance of spillage; and one can enjoy the snacks as well as the movie without interrupting anyone in the theatre.

SUMMARY OF THE INVENTION

An object of this invention is to provide a cup attachment which attaches to the top of a drinking cup; this unit on top will hold snacking foods. As a result, the regular drinking cup can now hold both a drink in the cup and a snacking food on the top of it at the same time.

DRAWING FIGURES

REFERENCE NUMERALS

Figure 1A:
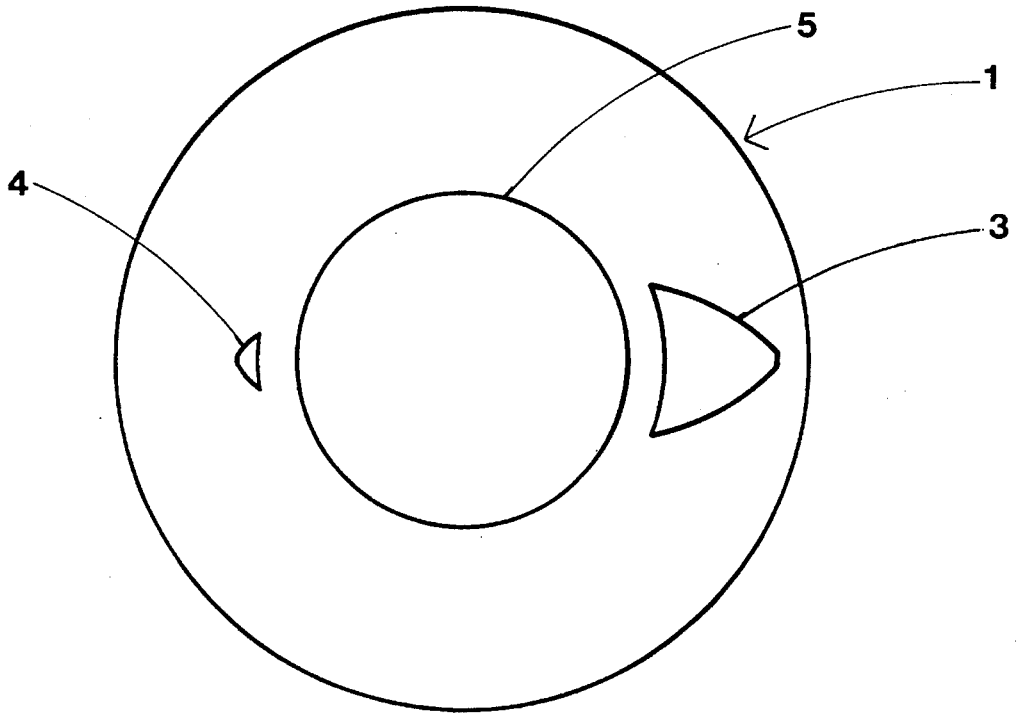
FIG. 1A is a top view of the conal container attachment showing the two openings on the conal container attachment wall.

1. conal container attachment
2. locking device
3. long opening
4. short opening
5. bottom opening
6. notch
7. ridges
8. cup and lid assembly
9. straw

DETAILED DESCRIPTION OF THE INVENTION

Figure 1B:
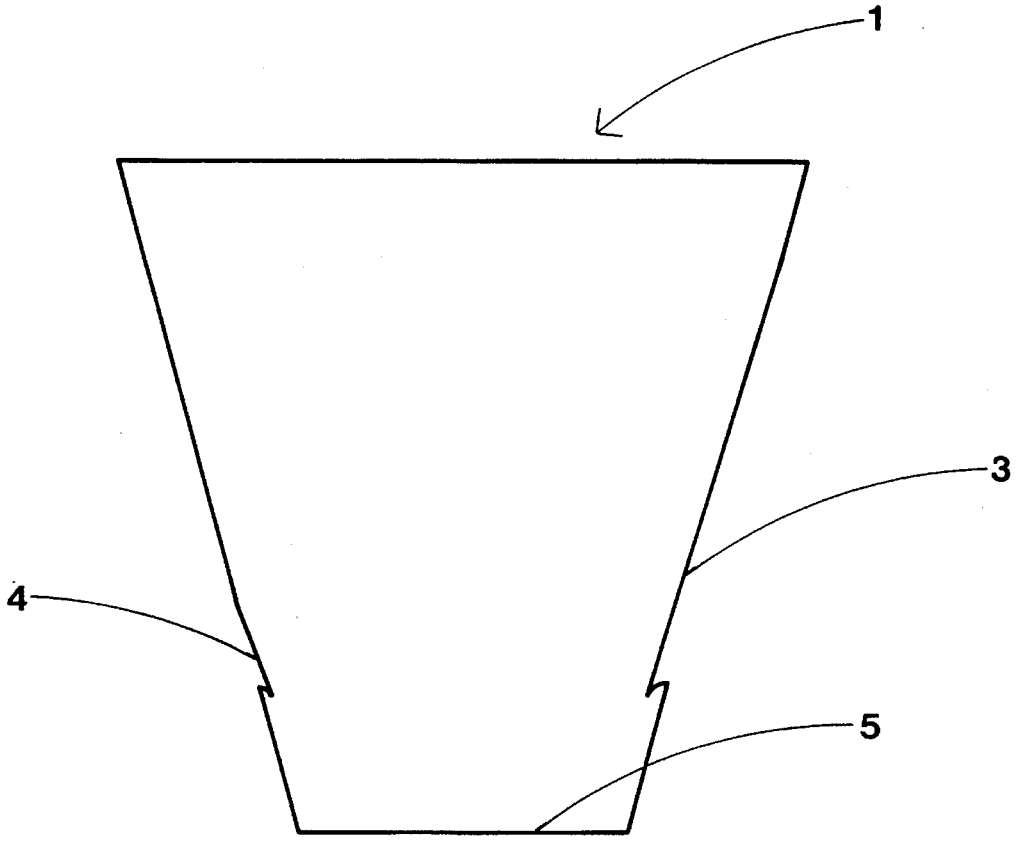
FIG. 1B is an elevation of the conal container attachment showing the two openings of the conal container attachment from the side view.
Figure 2A:
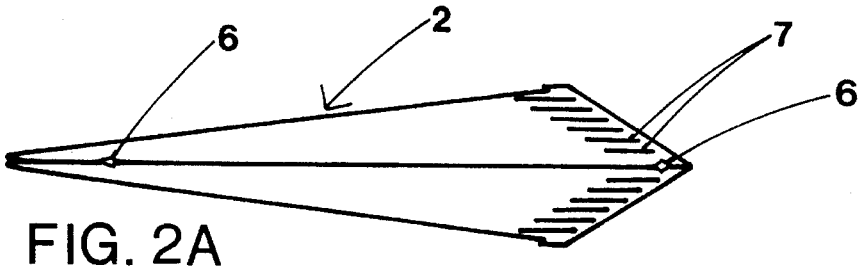
FIG. 2A is the top view of the locking device.
Figure 2B:
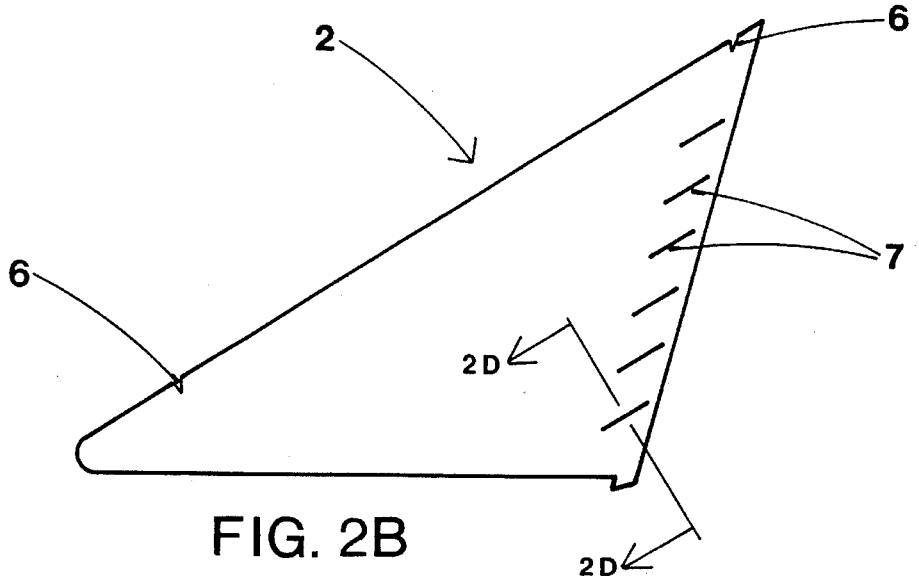
FIG. 2B is the side view of the locking device.
Figure 2C:
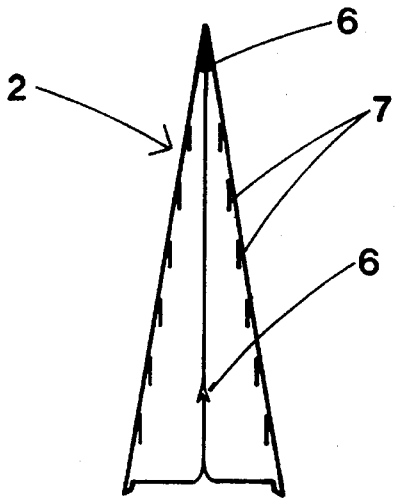
FIG. 2C is the front view of the locking device.
Figure 2D:
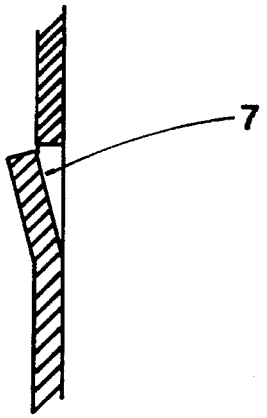
FIG. 2D is a detail of a typical ridge on the side of the locking device.

Refering to FIG. 1A and 1B, a conal container attachment 1 is shown comprised of a long wall opening 3, a short wall opening 4, and a bottom opening 5.

Refering to FIG. 2A to 2D, a locking device 2 is shown comprised of notches 6 and ridges 7.

Figure 3:
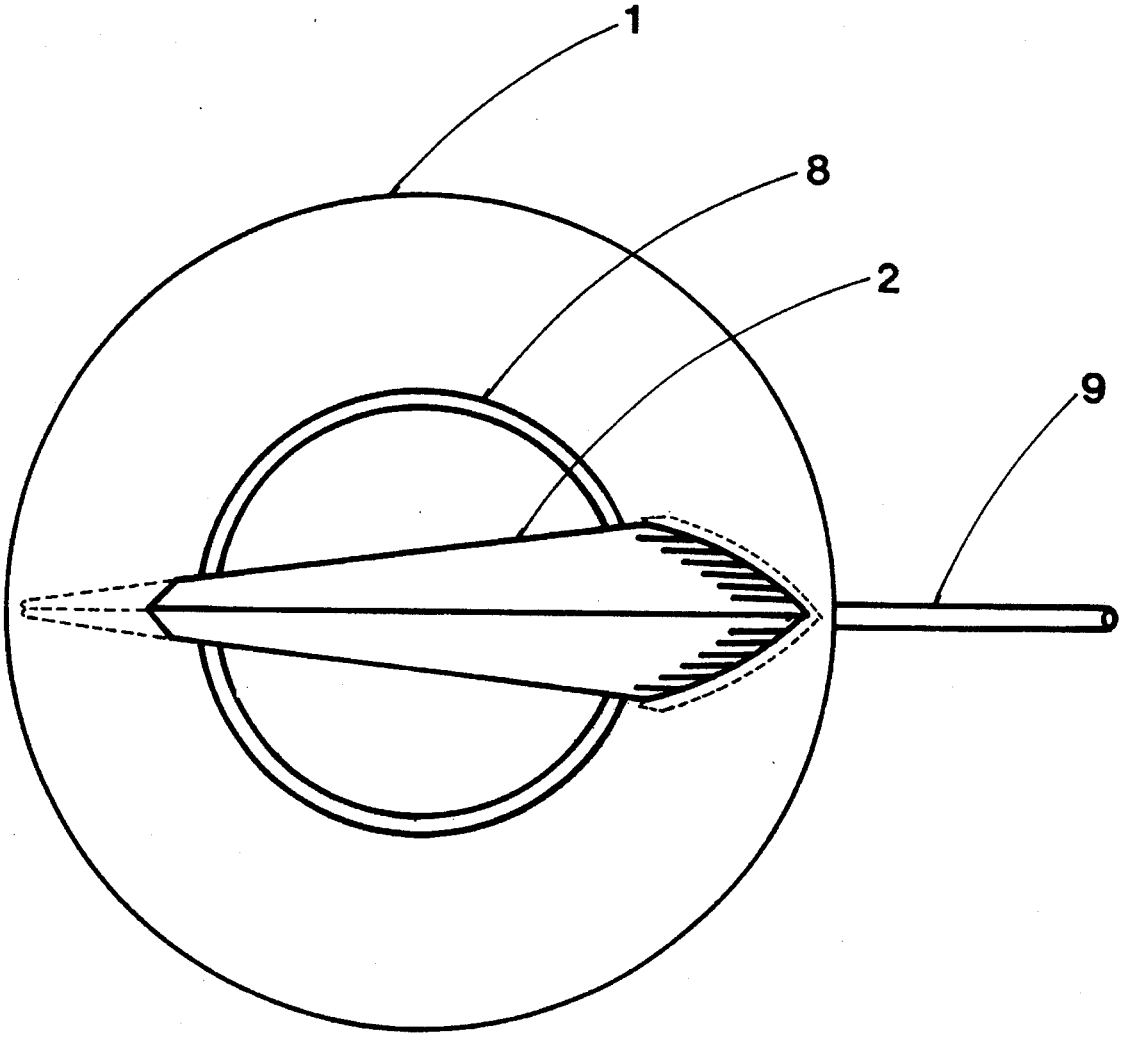
FIG. 3 is a top view of a full assembly of the cup attachment attached to a softdrink cup. The assembly shows the conal container attachment and the locking device attached to the top of the cup with a straw fitting into the cup from the side of the cup attachment.

FIG. 3 shows the present invention in full assembly attached to a cup lid assembly 8 with a straw 9 put into cup and lid assembly 8 from the side of the cup attachment.

Figure 4:
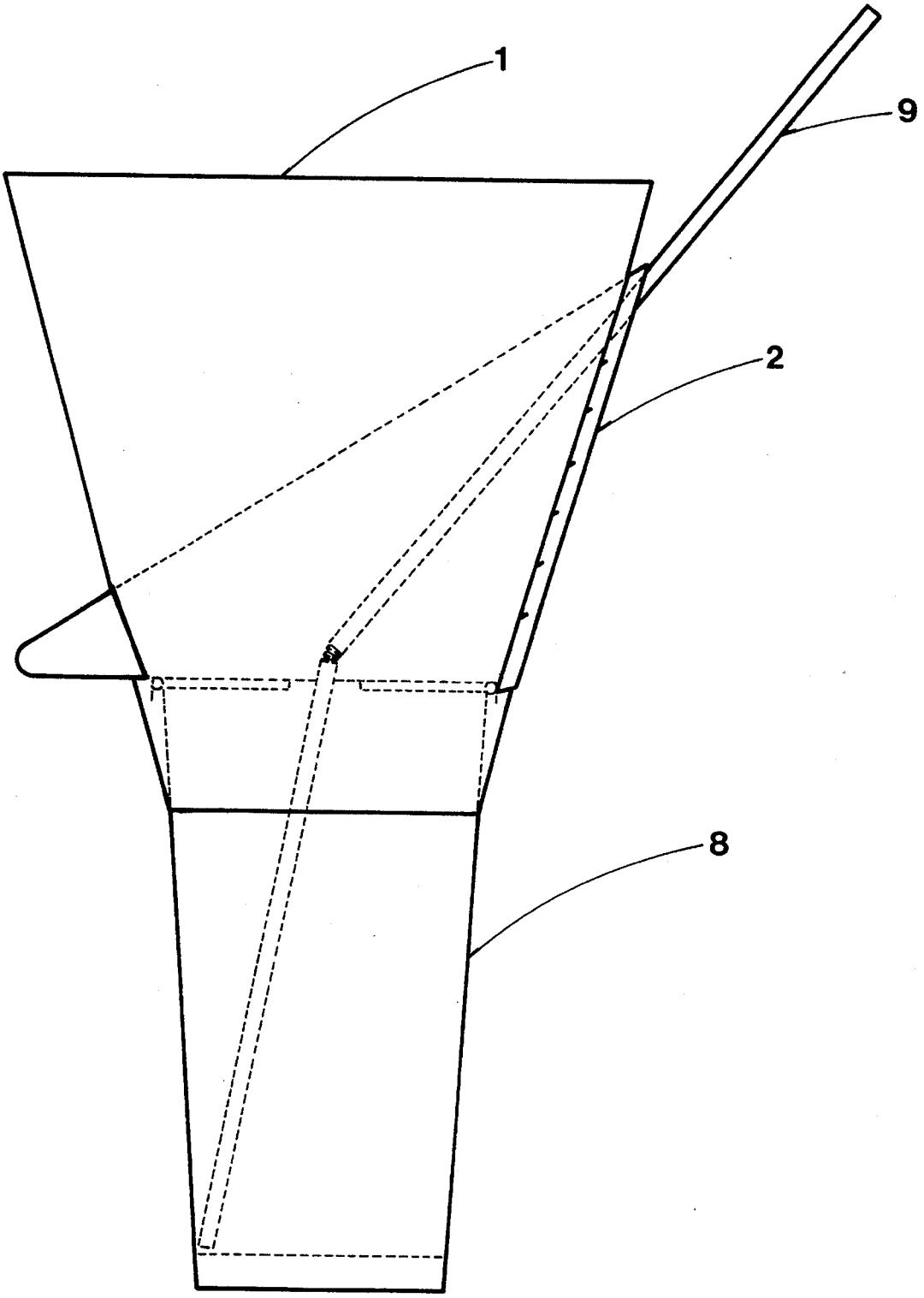
FIG. 4 is the side view of a full assembly of the cup attachment attached to a softdrink cup with a straw fitting into the cup from the side of the cup attachment.
Figure 5:
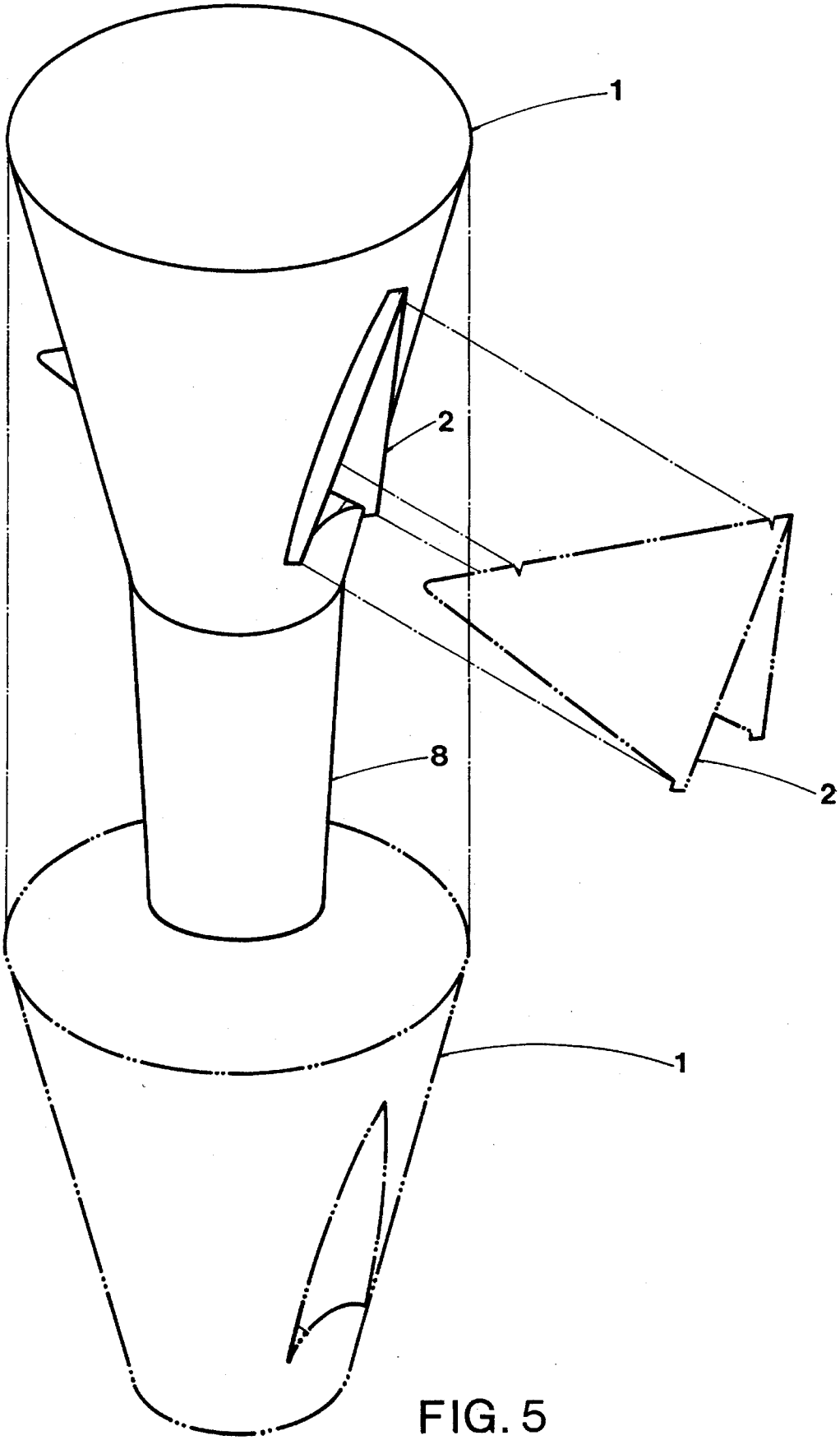
FIG. 5 is an isometric view of the invention in full assembly. This view shows the locking device and the conal container attachment before they come together to lock at the top of the cup and lid assembly.

FIG. 4 shows the full assembly of the present invention attached to a cup filled with a softdrink. In assembling the cup attachment to cup and lid assembly 8, one will first fill the paper cup with a consumeable drink, and close it with a lid typically made of styrene or some other kind of plastic. Then this cup and lid assembly 8 is placed into conal container attachment 1, where one pulls conal container attachment 1 upwards as shown in FIG. 5. When cup and lid assembly 8 lifts off the ground with conal container attachment 1, bottom opening 5 holds on to the upper portion of cup and lid assembly 8 momentarily by ways of friction. When this is done, one inserts locking device 2 into long opening 3 and through to short opening 4, where locking device 2 locks into conal container attachment 1 by ways of notch 6 snapping into the wall of conal container attachment 1, as shown in FIG. 4. Now the present invention in full assembly creates an enclosed container on the top of cup and lid assembly 8. This top container now is ready to be filled with a snacking food like popcorn. The space created between locking device 2 and cup and lid assembly 8 can be used to insert straw 9 into creased opening of the lid of the cup in order to reach the softdrink.

Ridges 7 on both sides of locking device 2 creates a barrier on long opening 3 where liquids like melted butter for popcorn is directed towards the middle of the container by ways of ridges 7 which are slanted downwards into the container. This system of ridges 7 will keep excess liquids from flowing out of the top container through long opening 3.

I claim:

1. An apparatus for forming a container to hold food and used in conjunction with a drinking cup having a lid, the apparatus comprising:

a. a generally frusto-conical shaped body having a bottom end with a bottom opening and a wider top end with a top opening, a chamber between the two openings, and a sidewall, the sidewall having a first opening and having an oppositely disposed second opening; and b. a partition means having a first end with retaining means thereon and an oppositely disposed second end with retaining means thereon such that the partition means can be inserted through the second opening in said sidewall and into said first opening in said sidewall and the retaining means on the partition means serve to retain the partition means in said sidewall of said frusto-conical shaped body;

c. whereby, said cup is first inserted through said frusto-conical shaped body and through said bottom opening such that a portion of the cup lies below the bottom end of the frusto-conical shaped body and a portion of the cup lies above the bottom end of the frusto-conical shaped body and is gripped by the sidewall at the bottom end, and the lid rests within the frusto-conical shaped body and forms a bottom to the chamber and the partition is inserted as described to retain the cup and lid in its position and prevent the cup and lid from sliding out of the frusto-conical shaped body.

2. The apparatus in accordance with claim 1 wherein at least one of said openings is sufficiently large to accommodate a straw to be inserted through said opening in the sidewall and through the lid of said cup and into the cup, whereby the partition further serves to provide a barrier between the food and the chamber and the straw.

3. The apparatus in accordance with claim 1 wherein said partition further comprises ridges which serves to prevent liquid from flowing out the openings in the sidewall of said frusto-conical shaped body.

4. An apparatus for forming a container to hold food and used in conjunction with a drinking cup having a lid through which a straw is inserted, the apparatus comprising:

a. a generally frusto-conical shaped body having a bottom end with a bottom opening and a wider top end with a top opening, a chamber between the two openings, and a sidewall, the sidewall having a first opening and an oppositely disposed second opening; and b. a partition having a first end with a first retaining means and a second end with a second retaining means, the first end inserted through said second opening in said sidewall and into said first opening in said sidewall and secured to the first opening by said first retaining means, the second end of the partition secured to the second oppositely disposed second opening of the sidewall through retaining means at the second end of the partition;

c. whereby, said cup and lid are first inserted through said frusto-conical shaped body and through said bottom opening such that the lower portion of the cup lies below the bottom opening while the upper portion of the cup lies above the bottom opening and is gripped by the sidewall located at the bottom opening and the lid is retained within said chamber and thereafter said partition is inserted and locked in place as described to thereby prevent said drinking cup and lid from sliding through said frusto-conical shaped body and said partition further serves as a barrier to cover said straw so that said straw can be inserted through one of the two openings in said frusto-conical shaped body and through said lid of said drinking cup.

5. The apparatus in accordance with claim 4 wherein said partition has ridges along at least one side for inhibiting flow of liquids through said opening of said sidewall of said frusto-conical shaped body.

6. An apparatus for forming a container to hold food and used in conjunction with a drinking cup for retaining liquid and having a lid for covering the drinking cup for retaining the liquid therein, the lid having an opening through which a straw can be inserted for drinking the liquid, the apparatus comprising:

a. a generally frusto-conical shaped body having a narrow end with a small opening, a widened end with a large opening, a hollow chamber between the large opening at the widened end and the small opening at the narrow end, and a sidewall having a short opening and an opposite long opening with the openings in the sidewall being closer to the narrow end and away from the widened end; and b. a partition having a first end with a first notch and a second end with a second notch, the first end inserted through said long opening at said sidewall of said frusto-conical shaped body and into said short opening in said sidewall of said frusto-conical shaped body and secured to said short opening by the first notch which latches said short opening at said sidewall of said frusto-conical shaped body such that the second end is secured at said long opening at said sidewall of said frusto-conical shaped body in the second notch which latches said long opening at said sidewall of said frusto-conical shaped body;

c. whereby said drinking cup is first slidably positioned through said hollow chamber and through said small opening of said frusto-conical shaped body such that the lower portion of said drinking cup is below said narrow end of said frusto-conical shaped body and the upper portion of said drinking cup rests above said narrow end of said frusto-conical shaped body and is gripped by the sidewall, where said lid closes said small opening at said narrow end of said frusto-conical shaped body and forms a bottom to said chamber to enable food to be retained in said chamber and then said partition is inserted as described to prevent said drinking cup and lid from sliding out of said frusto-conical shaped body and where said partition further forms a barrier to cover said straw which is inserted through said long opening at said sidewall of said frusto-conical shaped body and through said opening in said lid and into said drinking cup for drinking the liquid.

7. The apparatus in accordance with claim 6 wherein said partition has ridges along at least one side for inhibiting flow of liquids through said long opening at said sidewall of said frusto-conical shaped body.

* * * * *